United States Patent [19]

Singer

[11] Patent Number: 4,738,712

[45] Date of Patent: Apr. 19, 1988

[54] METAL FORMING

[75] Inventor: Alfred R. Singer, West Glamorgan, Wales

[73] Assignee: National Research Development Corporation, London, England

[21] Appl. No.: 853,716

[22] Filed: Apr. 18, 1986

[30]. Foreign Application Priority Data

Apr. 19, 1985 [GB] United Kingdom ..... 8510120
Dec. 13, 1985 [GB] United Kingdom ..... 8530821

[51] Int. Cl.[4] ..... B22C 7/00

[52] U.S. Cl. ..... 75/0.5 B; 75/0.5 C; 164/46; 164/127

[58] Field of Search ..... 75/0.5 C, 0.5 B; 148/3, 148/4; 420/590, 129; 164/122, 125, 127, 908, 46

[56] References Cited

U.S. PATENT DOCUMENTS 3,826,301 7/1974 Brooks ..... 164/46
3,909,921 10/1975 Brooks ..... 29/527.2
4,114,251 9/1978 Southern ..... 29/527.7
4,579,168 4/1986 Singer ..... 164/480

FOREIGN PATENT DOCUMENTS 218359 12/1983 Japan ..... 164/900
809412 2/1959 United Kingdom .
1262471 2/1972 United Kingdom .
1601181 6/1977 United Kingdom .

OTHER PUBLICATIONS

Metals Handbook, 9th ed., vol. 7, pp. 30, 45–49 © 1983. "Incremental Solidification", by A. R. E. Singer, published Metals Technology, Feb. 1983; Rheocasting, by Flemings, Riek and Young, published Materials Science and Engineering, 1976.

*Primary Examiner*—Christopher W. Brody
*Attorney, Agent, or Firm*—Cushman, Darby & Cushman

[57] ABSTRACT

Metal forming process and apparatus are described.

The process comprises directing a stream (4) of atomized droplets of molten metal onto a chill surface (5) such that the metal is partially solidified to form a slurry of solidified metal suspended in liquid metal. The slurry is then collected (for example, in a casting mold 7) and then cast or otherwise formed before solidification is complete. It is particularly preferred that the stream of atomized droplets is directed onto a fully solidified layer (6) of the same metal on the chill surface.

7 Claims, 3 Drawing Sheets

METAL FORMING

The present invention is concerned with a process of forming metal (the term "metal" is used herein to encompass both substantially pure metals and metal alloys), and apparatus therefor.

Metals are traditionally formed from the liquid state by casting. Conventional metal castings suffer from two main drawbacks, segregation and undesirably large grain size, which both result in relatively poor mechanical properties for the metal casting, and difficult subsequent fabrication where hot or cold working is necessary.

It has long been known that rapid solidification leads to finer grain size and reduced segregation but attempts to achieve rapid solidifications with large castings using conventional methods have not been found to be successful. It has also been known for a long time that providing a very large number of nucleation sites in a casting gives finer grain sizes and reduced segregation. This concept has been exploited by inoculation castings with nucleation sites by direct addition of the nucleants for this specific purpose.

We have now developed a metal forming process and apparatus therefor, which enables both large and small metal castings to be made with fine grain size and low segregation without the addition of special nucleating agents. The present invention accordingly provides a metal forming process, which comprises directing a stream of atomised molten metal onto a chill surface such that the metal is partially solidified to form a slurry comprising solidified metal suspended in still-molten metal, and flowing the slurry under liquid flow conditions to a receiving vessel for further processing.

By the term "slurry" is meant a coalesced mass of soldified metal dispersed in a matrix of molten metal.

According to a further aspect of the present invention, there is provided metal forming apparatus, which comprises a reservoir of molten metal, means for atomising molten metal drawn from said reservoir, means for directing a stream of atomised molten metal droplets produced by said atomising means onto a metal surface, means for cooling said metal surface such that it can chill said molten metal and cause partial solidification thereof, means for flowing partially solidified metal from said surface under liquid flow conditions and a receiving vessel for receiving said partially solidified metal.

In the process according to the invention, the impact of atomised droplets with the chill surface causes intense shearing action, which fractures and fragments dendrites already existing in the atomised particles in flight and dendrites formed in the liquid film remaining in prior splats at the time of impact. The fractured arms of solidifying metal are distributed throughout the freezing mass and act as nuclei for subsequent solidification leading to a fine grain size, while segregation is inhibited because the fragmented dendrite nuclei are destributed throughout the solidifying mass (preventing the formation of large pockets of liquid into which solute could be rejected).

Although the fragmentation of dendrites has been used in the past for producing fine grain size and low segregation castings, the methods used involve mechanical agitation or magnetic stirring. Mechanical agitation is difficult to operate economically, and frequently causes contamination of the product, whereas magnetic stirring produces less shear and fewer dendrite fragments. The process according to the present invention utilises the concept of directing a high velocity spray of molten droplets on to a chill surface so that cooling and shearing occur simultaneously by the formation of splats on the cooled surface.

The process according to the invention preferably involves the first splats forming a permanent thin skin or skull of fully solidified metal on the chill surface so that subsequently formed splats of partially solidified metal never come directly in contact with the chill surface but are cooled by metal of their own composition which is adhering to the chill surface.

The process according to the invention enables fine grain non-segregated products to be produced; a stream of molten metal is atomised to produce a spray of molten droplets which is directed towards a chill surface on which the droplets splat and cool to a temperature at which they are partially solidified and at the same time are subjected to intense shear caused by the splatting action itself. Impact of atomised droplets on earlier partly solidified splats causes further shearing. The partially solidified metal may be collected by, for example, passing it either into a mould in which it can solidify fully or into a container, which may be heated, from which it can be used for subsequent processing in the partially solidified state.

By "partially solidified", we mean that the metal mass described has cooled to a temperature at which it consists of metal crystals in a matrix of liquid metal. Such a mass, under equilibrium conditions, could exist at temperatures between the solidus and liquidus in the case of alloys and at the melding point in the case of pure metals.

During all atomising processes using molten metals some of the atomised particles will remain fully liquid even though their temperature has fallen below the liquidus. This is a well-known phenomenon called "undercooling" or "supercooling". Such undercooling typically applies to some of the smaller particles when it may be in the region of 50°-200° C. As soon as a nucleus, such as a dendrite, is formed or the particle splats onto a partially solidified prior splat, it will crystallise. Undercooling therefore has little influence on the process of the invention.

Atomisation may be achieved by various methods, including gas atomisation, pressure jet, mechanical or centrifugal atomisation. It is normally required to maintain an inert or reducing atomosphere within the atomisation chamber to avoid oxidation of the metal being atomised and for this reason water atomising is generally precluded, although atomisation of certain metals by a mixture of hydrocarbons and steam is permissible. In the following description, reference will be made to gas atomisation, although it should be understood that other atomisation processes such as those mentioned above (in particular centrifugal atomisation) can be used.

When using gas atomising in the process of the invention, some cooling of the droplets of molten metal will be caused by the gas, and some of the smaller droplets may be partially or fully frozen in flight, but the main cooling effect generally occurs when the droplets strike the chill surface. At the commencement of the process such a surface is usually a water cooled solid metal surface which may be of the same composition as the sprayed metal, or different. It will be appreciated that the first few layers of splats formed on such a chill surface will be solidified completely and will not pass into the receiving vessel. In fact the first few layers of splats will show distinct splat boundaries when examined in section showing that prior splats have solidified fully before the arrival of droplets forming the next layer. As the layers of splats increase in number and the thickness of deposit increases, the rate at which heat is conducted away from the chill surface decreases. From simple solidification theory it can be assumed that the rate of solidification will be proportional to the inverse root of the thickness of the underlying deposit.

All this takes place rapidly, and within a short time, usually a few seconds, a stable situation will be reached in which the last layers of splats are only partially solidified. These splats containing partially solidified metal will be in the form of a slurry containing fractured dendrites and can be caused to flow, for example, under gravity and/or driven by the impact of later droplets and pressure of the atomising gas, into the receiving vessel.

When a stable situation has been reached, droplets of the spray will impact a surface consisting of a partially solidified film of metal. This film will contain small dendrite crystals in a matrix of liquid metal. The arms of the dendrites will be fractured, fragmented and distributed within the film by the impact of the newly arriving droplets when the splat on the partially solidified film.

Any droplets that are partly solidified in flight by the cooling action of the atomising gas will also suffer shearing and fragmentation of dendrite arms within the droplet when it strikes the partially solidified film and forms a splat.

The net result of the intense shearing action of splatting is that the film of partially solidified metal consists of a mass of fragments of dendrites in a matrix of liquid. Such a mixture has the consistency of a slurry. It has a much lower viscosity and will flow much more readily than a mixture having the same composition and proportion of liquid but without fractured dendrite arms (such as would occur during the normal solidification of a casting).

The difference in viscosity is substantial. For example, the viscosity of a mass of metal 50% solidified under the relatively quiescent conditions and relatively low cooling rate of conventional castings is so high that it will not flow under gravity because of the interlacing network of large dendrites which enclose cells of the remaining liquid. By contrast a mass of metal of the same composition produced by splatting has far smaller dendrites (because of the higher rate of cooling), and all the dendrite arms are fragmented. There is no network of dendrites and with 50% solid the mass has a low viscosity and flows readily.

In order that the present invention may be more fully understood, there will now be described exemplary embodiments of apparatus according to the invention, reference being made to the accompanying drawings, in which.

Figure 1:
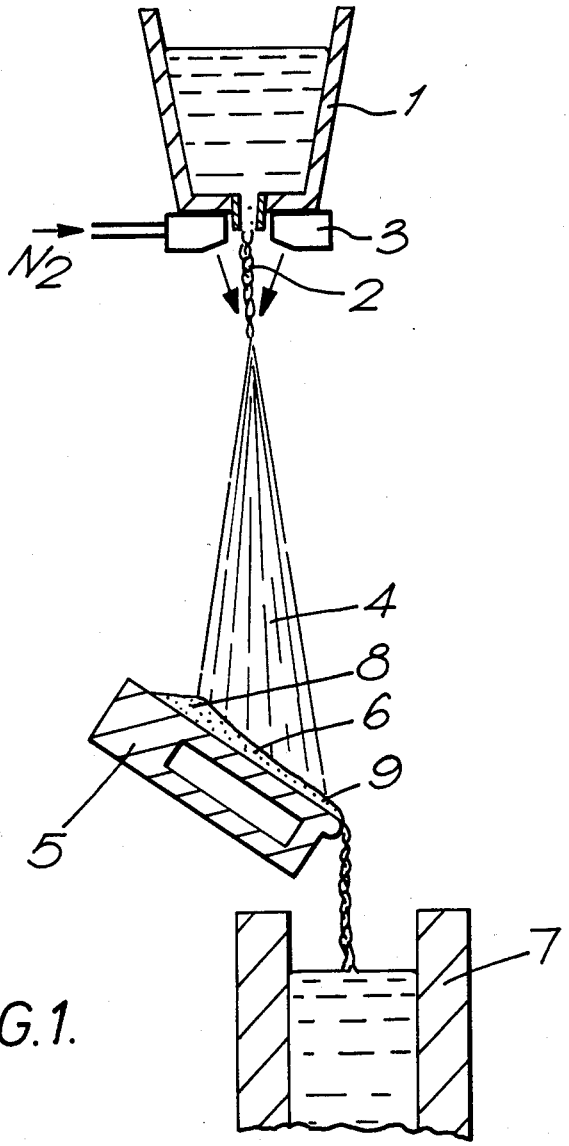
FIG. 1 is a side elevation of a very simple case of apparatus according to the invention.

Referring to FIG. 1, there is shown a tundish of molten brass 1 from which a stream of metal 2 is delivered vertically through a gas atomiser 3 which directs convergent jets of high pressure $N_2$ on to the molten brass stream. The steam is atomised to form a spray of molten brass droplets 4 which are directed on to a water cooled copper surface 5 which surface is inclined at an angle of 60° to the axis of the spray. A thin layer 6 of solidified splats (a skull) quickly forms on the water cooled copper surface; the skull increases in thickness until the heat conducted away from the newly arriving droplets is no longer sufficient to solidify them fully. A film of partially solidified brass then forms at the deposit/ gas interface which consists of a slurry of fragmented dendrites in a matrix of molten metal. This partially solidified brass has low viscosity and runs off the underlying solid skull into the mould 7 where it solidifies.

The exemplified process has several important features, as follows:

(i) Because the skull of solidified brass separates the water-cooled copper surface from the impinging liquid droplets there is no contamination or dilution of the brass and no erosion of the copper.

(ii) To economise expensive nitrogen, high pressure gas (in this case 5 MPa) is used at a low volume (for example, at the rate of 10% of the weight of the brass). Cooling of the particles in flight by the gas is relatively small compared with cooling by the water cooled surface.

(iii) The skull is thickest at the top 8 of the water cooled surface; it is thinner at the bottom 9, where it is subjected to a heavier stream of atomised droplets and where the partially solidified brass is continually running over the surface. The thickness of the skull is to some extent self regulating at any one point because if a small rise in the rate of spraying occurs and the skull becomes unduly thin at that point heat conduction will increase, more liquid will be frozen, and the layer will stabilise at a slightly reduced thickness. Similarly, the situation is self-regulating if the skull for some reason thickens at any one point as a consequence, for instance, of a fall in the rate of spraying.

(iv) The partially solidified metal running into the mould will contain a vast number of nuclei in the form of fragmented dendrites to produce a fine grain casting when fully solidified.

(v) As part of the latent heat of solidification has already been removed by the surface the metal will solidify more rapidly with less mould cooling required. It will also show reduced segregation because no large reservoirs of liquid are present into which solute could be rejected.

Figure 2:
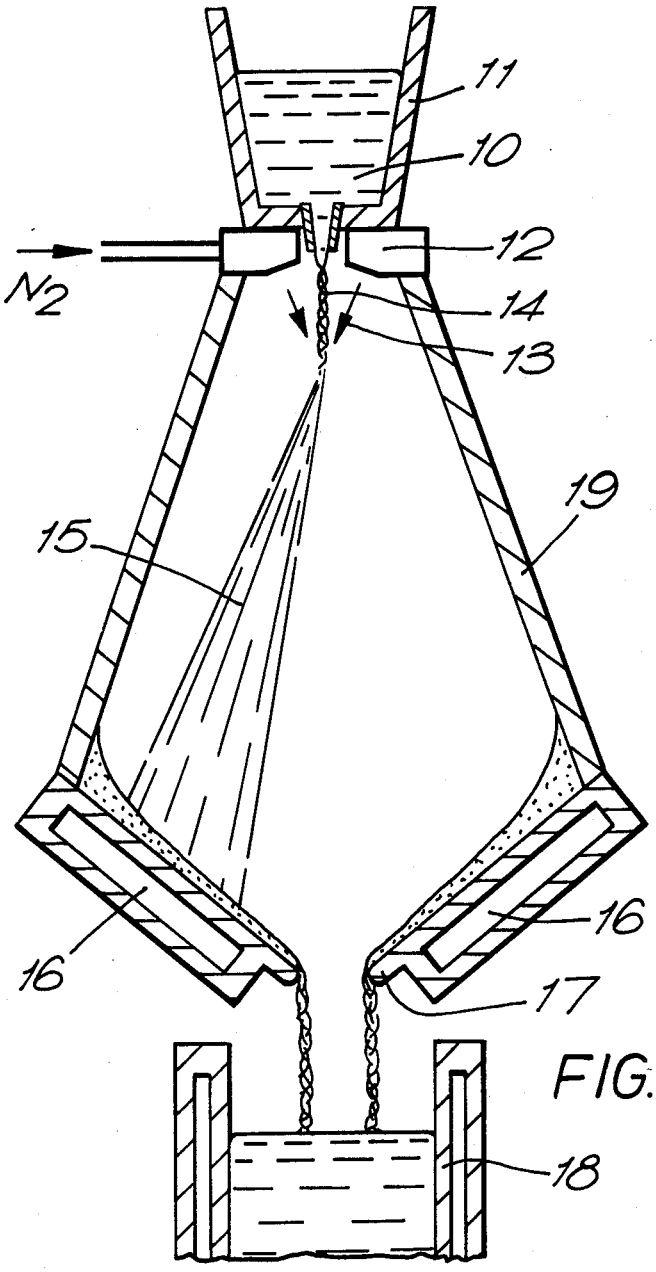
FIG. 2 is a side elevation of somewhat more complex apparatus according to the invention.

While the simple system of FIG. 1 illustrates the pinciples of the present invention, a more preferred arrangement which ensures continuous running and good economy on a production scale will now be described. Referring to FIG. 2, molten steel 10 is allowed to flow vertically downwards in a stream (typically of diameter 1 cm) from a tundish 11 through a gas atomiser 12 which directs convergent jets of high pressure $N_2$ 13 on to the stream of molten steel 14. The stream is atomised to form a spray of molten steel droplets 15 directed on to a water cooled copper surface 16. In the case illustrated the system is axisymmetric and the water-cooled copper surface 16 is in the form of an inverted truncated cone forming the bottom part of a chamber and having an included angle of 100°.

An exit orifice 17 is formed at the free ends of surface 16 to allow partially solidified metal and gas to exit into a continuous casting 18. The top of the chamber has a refractory lining 19 and seals on to the atomiser 12 which itself seals on the bottom of the tundish 11.

In operation, gas can be supplied at a pressure of 4 MPa and at a rate of 7% of the metal weight. The atomiser operates such that the cone of spray rapidly rotates around the axis of the atomiser (as shown in FIG. 2). The spray cone of atomised droplets is directed on to the inclined water cooled copper surface 16. The included angle of 90% of the spray is 10° in the embodiment illustrated and it is arranged that only a small fraction of the spray, i.e. the periphery of the spray cone, reaches the exit orifice 17 of the refractory lining 19. A small proportion of the spray entering into the mould without impinging on the surface is not important and will simply be incorporated in the casting. In fact the metal droplets impinging directly on the partly solidified metal in the mould will produce further fracture of dendrites. Similarly the small proportion of spray despositing on the refractory lining 19 will not solidify completely because heat conduction away from the splatted droplets by the refractory lining will be low. The liquid or partially solidified metal will flow downwards to join the main stream of partially solidified metal and eventually will reach the mould. If required, part or all of the refractory walls may be heated to further reduce the likelihood of full solidification and metal build-up in the high regions.

Rotation of the atomised spray cone about the axis of the system as shown in FIG. 2 is also beneficial because the point of maximum delivery of droplets, i.e. the centre of the spray, is continually moving.

This avoids localised thinning of the skull and avoids a build-up of thickness above and below the plane of the paper in FIG. 2. If required, the spray can be held stationary while the surface is moved or rotated, which has the same beneficial effect. However, it is usually more convenient ot move the spray than the surface. If both the surface and the spray are moved the shearing action is increased and the beneficial effects are further improved if the movement of the spray and the surface are in opposite directions.

In both examples given above atomisation is used to disintegrate the molten metal mass. In these cases there is the danger of some gas being entrained in the slurry, resulting in a porous casting. Precautions should therefore be taken to ensure that gas velocities at the point of impact with the cooled surface are minimised and that there is adequate provision for the exit flow of the gases at low velocity over the metal surface. One method of reducing porosity is to lower the equipment until the water-cooled portion 16 touches the top of the mould 18. An exit port for gases is then provided towards the top of the refractory lining 19. This procedure minimises porosity when using gas atomisation although there is a small penalty in the form of a greater escape of small metal particles which may result in slightly lower yields.

This difficulty can also be surmounted to a great extend in an alternative form of the invention in which molten metal is allowed to fall onto the disc or impellor of a centrifugal atomiser which is most conveniently arranged with a vertical axis.

Figure 3:
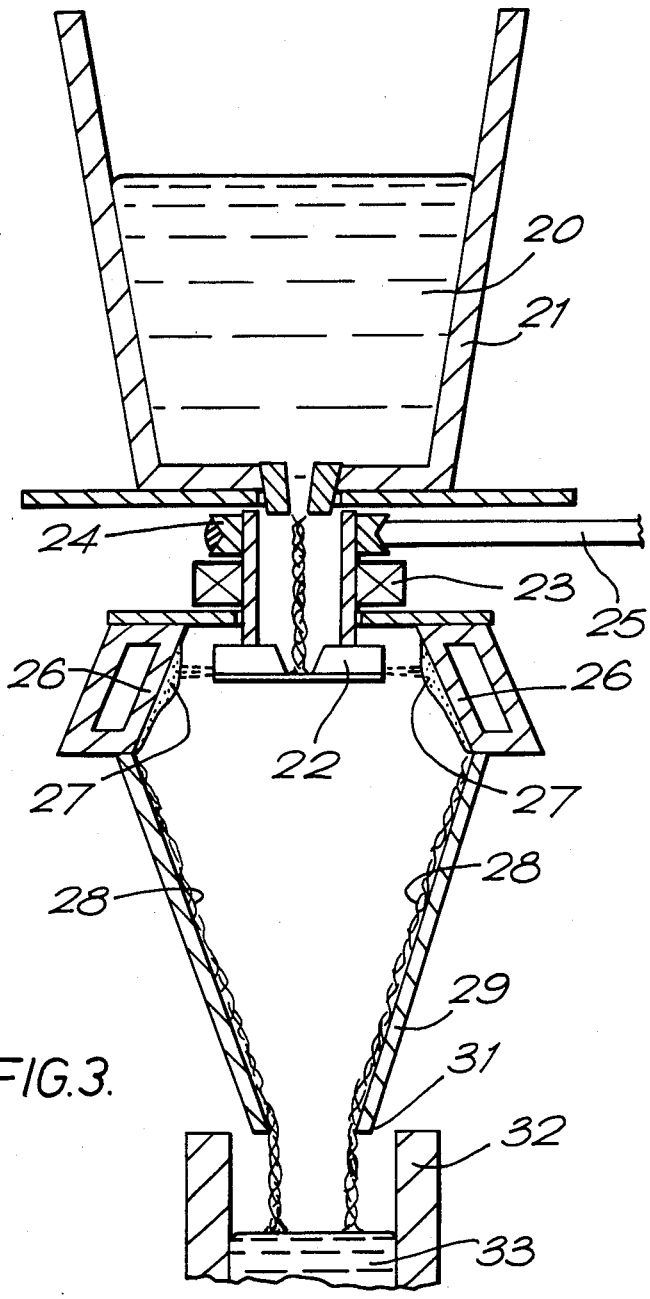
FIG. 3 is a side elevation of a further embodiment of apparatus according to the invention, in which the metal is atomised centrifugally.

An example is given in FIG. 3. Molten metal 20 is allowed to flow from tundish 21 to a rotatably driven impellor 22 which is retained in an annular water cooled bearing 23 and driven by means of a pulley 24 and V-belt 25 connected to an electic motor (not shown), whereby the impellor, which may consist of water cooled metal, a ceramic coated metal or a ceramic, can be rotated at speeds of, for example, 1000 to 4000 rpm.

Molten metal is atomised by the impellor 22, forming a spray in a horizontal plane. The resulting atomised molten metal is caused to splat on an inclined, water-cooled chill surface 26 in the form of a truncated cone so producing simultaneously cooling, shearing and fracture of dendrite arms to produce a skull 27 from which the slurry of dendrites and molten metal 28 runs down the sides of a refractory cone 29 via exit opening 31 into a mould 32 to form a casting 33.

The special advantage of this equipment is that a minimum of gas can be used - merely sufficient to purge the atmosphere within the equipment and to maintain a protective atmoshere-yet an intense splating and shearing action occurs, causing fragmentation of dendrites and achieving the benefits of the invention. Because of the minimal use of gas there is less likelihood of porosity occurring in the casting.

In an alternative form of the invention a very pronounced shearing action can be caused by a spray of metal being directed at a very rapidly rotating surface of a cooled drum or disc on which it partially solidified and is then thrown off by centrifugal action. Such a system produces a similar product to that produced by the equipment shown in FIG. 3 and has the same economy in the use of gas. The main objection is that with such a system it is difficult to direct the off-coming stream of partially solidified metal accurately into a mould or container with the consequences that metal recovery may be poor.

In any of the examples described, the off-coming stream of sheared, partially solidified metal consisting of a slurry of fragmented dendrites in a molten matrix will have adequate fluidity to form either a simple billet or ingot or a shaped casting. It is not necessary to have a high proportion of solidification; it is merely necessary to have large numbers of dendrites or fractured dendrites within the mould to ensure a large number of nucleation sites and therefore a fine grain size. It can solidify to form a fine grain casting with very low segregation. The mechanical properties of such a casting at room temperature can be improved compared with those obtained using a similar composition and conventional casting techniques. Products produced by the process of the invention also show improved hot and cold working properties because of their low segregation and fine grain size.

The process of the invention can be applied to all metals or alloys that can be used for melting and casting. It is preferred but not essential that an inert or reducing gas is used when gas atomising in which case it can also provide an atmosphere and conveniently protect the solidifying metal in the mould.

In the case of an alloy the process can be controlled by measuring the temperature of the alloy flowing off the surface into the mould or container. As the system is likely to be near equilibrium a comparison with the equilibrium diagram will indicate the approximate proportion of solid existing between the solidus and the liquidus.

A more practical and convenient means of control is to observe the way in which the processed metal runs from the exit opening 17 in FIG. 2 and 31 in FIG. 3. If too much solid exits in the processed metal stream it will be "lumpy". A more accurate test is to pour a small quantity into a fluidity or spiral mould. This will give an immediate indication of the viscosity of the processed metal. A degree of fluidity is preferably used which is the minimum consistent with producing a sound, fine grained non-segregated casting. If the slurry used in the process according to the invention is too fluid, i.e. with too few nuclie, the viscosity and proportion of solid can be increased by increasing the atomising gas pressure in the case of gas atomising and/or the cooling of the chill surface. Similarly if the viscosity is too high it can be reduced by decreasing the atomising gas pressure and/or decreasing the water flow in the chill surface.

In some cases it will be required to process the slurry still further whilst still only partly solidified. This may be achieved by using a heated container held at an appropriate temperature between the solidus and liquidus. The product will remain in a usable condition for some time at constant temperature but gradual deterioration will occur and it is therefore wise not to delay further processing for longer than can be avoided.

I claim:

1. A metal casting process, which comprising directing a stream of atomized metal on to a chill surface so as to initially form a fully solidified metal layer and continuing directing a stream of the metal onto said formed metal layer to cause the metal of the stream to partially solidify in the form of a slurry comprising solidified metal suspended in still-molten metal;

flowing the slurry under liquid flow conditions into a casting mold; and allowing the slurry to solidify in said mold.

2. A metal casting process, which comprises splatting a stream of atomized droplets of molten metal on to a chill surface to cause partial solidification of the metal, and fracture and fragmentation of dendrites in the partially solidified metal by subsequently impacting atomized metal thereon, such that the latter has the consistency of a slurry comprising fractured dendrites in still-molten metal;

flowing said partially solidified metal into a casting mold; and allowing the material in said mold to solidify.

3. A process according to claim 1 or 2, in which a substantially fully solidified layer of said metal is initially formed on said chill surface such that a steady state is reached in which the atomised molten metal impacts a surface consisting of partially solidified metal overlying said substantially fully solidified layer.

4. A process according to caim 1, in which the molten metal is atomised by means of jets of an inert or reducing gas directed at a falling stream of said molten metal.

5. A process according to claim 2, in which the molten metal is atomised centrifugally.

6. A process according to claim 2, in which said slurry flows off said chill surface directly into said receiving vessel.

7. A process according to claim 1, in which said chill surface is in the form of an inverted truncated cone and said stream is caused to rotate about the axis of said truncated cone such that the area of impact between said stream and the chill plate is itself in the form of a truncated cone.

* * * * *